US011078065B2

(12) United States Patent
Doblinger et al.

(10) Patent No.: US 11,078,065 B2
(45) Date of Patent: Aug. 3, 2021

(54) FILLING SYSTEM FOR FILLING A CONTAINER WITH A FILLING PRODUCT

(71) Applicant: KRONES AG, Neutraubling (DE)

(72) Inventors: Josef Doblinger, Neutraubling (DE); Stefan Poeschl, Neutraubling (DE); Tobias Bock, Neutraubling (DE); Matthias Stubenhofer, Neutraubling (DE)

(73) Assignee: KRONES AG, Neutraubling (DE)

( * ) Notice: Subject to any disclaimer, the term of this patent is extended or adjusted under 35 U.S.C. 154(b) by 241 days.

(21) Appl. No.: 16/306,875

(22) PCT Filed: Aug. 24, 2017

(86) PCT No.: PCT/EP2017/071281
§ 371 (c)(1),
(2) Date: Dec. 3, 2018

(87) PCT Pub. No.: WO2018/037063
PCT Pub. Date: Mar. 1, 2018

(65) Prior Publication Data

US 2021/0039938 A1 Feb. 11, 2021

(30) Foreign Application Priority Data

Aug. 26, 2016 (DE) ..... 10 2016 115 891.7

(51) Int. Cl.
*B67C 3/26* (2006.01)
*B67C 3/24* (2006.01)

(52) U.S. Cl.
CPC ..... *B67C 3/26* (2013.01); *B67C 3/24* (2013.01); *B67C 2003/2671* (2013.01)

(58) Field of Classification Search
CPC ..... B67C 3/26; B67C 3/24; B67C 2003/2671
See application file for complete search history.

(56) References Cited

U.S. PATENT DOCUMENTS 6,123,269 A * 9/2000 Schmitkons ..... B05C 5/0212 118/640
9,365,403 B2 * 6/2016 Vorwerk ..... B67C 3/04

FOREIGN PATENT DOCUMENTS

| | | |
|---|---|---|
| DE | 10 2011 016760 | 10/2012 |
| DE | 10 2014 110162 | 1/2016 |
| EP | 2269943 | 1/2011 |
| EP | 2987764 | 2/2016 |
| WO | WO 2011/007370 | 1/2011 |

OTHER PUBLICATIONS

Jefferson Lab, "Static Electricty and Water", Mar. 19, 2009, https://www.youtube.com/watch?v=VhWQ-r1LYXY&feature=emb_logo (Year: 2009) (relevant screen shots included).*
International Search Report and Written Opinion issued in International Patent Application No. PCT/EP2017/071281 dated Nov. 28, 2017.

* cited by examiner

*Primary Examiner* — Jason K Niesz
(74) *Attorney, Agent, or Firm* — Haynes and Boone, LLP

(57) ABSTRACT

A filling system for filling a container with a filling product includes a filling device for filling the container with the filling product, and a deflection device having an electrostatic field for deflecting the filling product relative to the container.

18 Claims, 2 Drawing Sheets

FILLING SYSTEM FOR FILLING A CONTAINER WITH A FILLING PRODUCT

CROSS REFERENCE TO RELATED APPLICATIONS

This application is a national stage of International Application No. PCT/EP2017/071281, filed Aug. 24, 2017, which claims priority from German Patent Application No. 10 2016 115 891.7 filed on Aug. 26, 2016 in the German Patent and Trademark Office, the disclosures of which are incorporated herein by reference in their entirety.

BACKGROUND

Technical Field

The present invention relates to a filling system for filling a container with a filling product, for example for filling glass or plastic bottles with beverages.

Related Art

Filling systems are known in which the containers that are to be filled are conveyed in transport devices that are designed as rotary machines or carousels. It is for example known in this context to carry out the filling of the containers that are to be filled in a rotary filler, which rotates about its axis during the filling, wherein the filling elements for the actual filling with the filling product of the container that is to be filled are provided on the periphery of the rotary filler.

Various filling processes are known for this. They differ, for example, according to whether the container that is to be filled is pressed onto the applicable filling element, thus creating during the filling process a fluid-tight connection between the filling element and the container that is to be filled, or whether the filling is carried out by means of a so-called "free jet" process, in which the stream of filling product from the filling valve falls into a container to be filled that is disposed beneath it, without a fluid-tight seal being provided between the container that is to be filled and the filling element. In other words, in a free-jet portion of the free jet process the filling product falls into the container that is to be filled in an unguided manner and without protection.

Due to the rotation of the rotary filler, the stream of filling product is deflected radially outwards as a result of the centrifugal force that acts on the filling product during the filling process. Thus in conventional rotary filling devices there is an upper limit to the possible speed of rotation during free jet filling. This limit depends, among other factors, on the deflection of the free-jet stream of filling product due to the centrifugal force. If this speed is exceeded, it can occur during the filling process that the free jet also impinges in the area of the mouth of the container that is to be filled. In this case, not all of the free jet can be conveyed into the interior of the container, and it is not possible to guarantee that the container will be reliably and completely filled with the stream of filling product. This can also lead to contamination of the plant.

In beverage filling plants, it is also known to transfer the containers, after they have traversed the rotary filler and have been filled with the filling product, to a downstream transport device, for example a transfer starwheel, in which the container filled with filling product is again conveyed in a circular path. The transport devices, and in particular the transfer starwheels, are provided in order to convey the container, which is filled with the filling product but not yet closed, to a closing device, wherein the closing device can similarly be designed as a rotary capper.

At each transfer point, for example from the rotary filler to a transfer starwheel, between individual transfer starwheels, and from the transfer starwheel to the rotary capper, there is, due to the non-coincident axes of rotation, a change in the centrifugal forces that that are produced by the rotation and act on the containers, and hence on the filling product in the containers. Thus at each transfer point there is also a change in the forces acting on the filling product, such that at this point an impulse is applied to the filling product that can lead to a sloshing motion of the filling product inside the container. In this case too, an upper limit is set to the speed of rotation of the individual rotating transfer devices that transfer between them the containers that are filled with filling product, since the filling product must be prevented from sloshing out of the container that is filled with filling product.

SUMMARY

A filling system which has increased performance and/or a reduced sloshing tendency is described according to various embodiments.

Accordingly, a filling system for filling a container with a filling product is proposed, which includes a filling device for filling the container with the filling product. A deflection device having an electrostatic field for deflecting the filling product relative to the container is provided.

Due to the fact that a deflection device having an electrostatic field is provided, in those areas of the filling system in which excessive deflection of the filling product takes place, for example due to the centrifugal forces which arise, and this deflection leads to sloshing over of the filling product in the container, and/or leads to inaccurate impingement of the stream of filling product on the container during the filling process, it is possible to effect a deflection of the filling product or stream of filling product that counteracts the undesired deflection.

This procedure utilizes the fact that water has a dipole moment, and when an electrostatic field is applied the negatively charged ends of the water molecules are attracted by the positively charged end of the electrostatic field. Thus a deflection or diversion of the filling product can be achieved by means of the application of the electrostatic field by the deflection device.

Thus when, for example, a filling product is filled using the free jet method, in which the stream of filling product traverses an open space between the filling element and the container that is to be filled, by the application of the electrostatic field an effect on the filling product can be achieved such that the attractive force created by the electrostatic field counteracts the centrifugal force. By this means, the deflection of the stream of filling product due to the centrifugal force can be reduced, cancelled or even reversed. The force exerted on the filling product is dependent on the strength of the electrostatic field that is applied and actually acts on the filling product.

In addition, by means of the use, i.e. application, of the electrostatic field, it can be achieved that when filled containers are transferred from one transport device to another, and/or when the filled container is transferred from the filling device to a transport device, or from a transport device to a closing device, it is similarly possible for a deflection device with an electrostatic field to act on the filling product such as to counteract excessive deflection of the filling product due to the impulse applied in the transfer regions, and/or due to the change in the forces acting on the filling product in each case. It can thereby be achieved that a tendency of the filling product in the filled container to slosh or slosh over in the region of each transfer point from one transport device to the next can be reduced or entirely eliminated.

It can thus be achieved by the provision of the deflection device, which has an electrostatic field, that the same filling system can be operated more reliably, since improvement is made in the sloshing or sloshing-over of filling product out of an already filled container at each of the transfer points, and/or the filling with filling product of a container that is to be filled by means of a free jet is more accurately directed. The overall tendency to slosh over or splash can be reduced, and in this manner a more exact filling outcome can be achieved, since in this manner the quantities of filling product that unintentionally do not flow into the container, or that escape from the container, can be reduced or eliminated.

By the use of a deflection device, which uses an electrostatic field for deflection, it is further possible to achieve particularly hygienic filling, since it is not necessary to make contact with the filling product in order to deflect it. Instead, by means of a suitable device the electrostatic field can be provided such that it is spaced apart from the actual filling product, i.e. stream of filling product, such as to exclude any hygienic impairment of the filling product by the deflection device. Hence it is possible to combine the advantageous effects of free jet filling, which include the obviation of the necessity for the filling element to make contact with the mouth of the container that is to be filled, with the requirements for a high speed of rotation of a rotary filler, in order either to improve the performance of the system or to decrease the necessary radius of the rotary filler.

Furthermore, by means of the deflection device it is also possible to deflect the free jet such that it can impinge upon a point of impingement of the free jet within the receiving space provided by the container that is to be filled. This is for example of importance when filling with filling product which has a high tendency to foam. The tendency to foam during the filling process depends, among other factors, on the point of impingement of the filling product in the container that is to be filled. It can, for example, be advantageous here to direct the stream of filling product such that it first impinges upon an inner wall of the container that is to be filled. From this point it then slides to the base of the container, so that the filling product is, as it were, decanted, at least at the beginning of filling. It can however also be advantageous for the point of impingement to be provided on the base itself of the container that is to be filled, in order in this manner to reduce the tendency to foam. Thus by means of the proposed deflection device, through the application of the electrostatic field it is also possible, along with the advantageous effects described above, to reduce the tendency of the filling product to foam, such that the overall performance of the system can be enhanced. This is particularly the case because if the tendency to foam is reduced the filling process as a whole can be shortened, and the time that may need to be provided for the filling product to settle can be reduced.

In addition, by means of the provision of the deflection device it is also possible to reduce the sloshing over or overflowing tendency in the areas in which filled containers are transferred from one transport device to another transport device. The overall output of the system can thereby be increased, since in this manner the sloshing of the filling product out of the containers, and/or the inaccurate impingement of the stream of filling product in the containers, is at least reduced, and may be fully eliminated. Thus for a given size of system the overall output can be increased. Alternatively, the size of the system can be reduced, since the speeds of rotation of the individual transport devices, for example the rotary filler or the transport starwheels, can be increased, and their radii can be correspondingly reduced.

In consequence, there is an increase in the overall efficiency of the system.

In certain embodiments, the filling device is designed for filling the container by the free jet method, and the deflection device acts on the free jet. In this manner it is possible to combine the advantageous effects of filling by the free jet method with the requirements for increased performance of the system or a compact design of the system.

In various embodiments, a transport device for transporting the filled container is provided, and the deflection device acts on the filling product accommodated in the container. By this means it is possible to avoid overflow or outflow of filling product due to the centrifugal forces that arise, so that the performance of the system can be further improved.

In an advantageous further development, the filled container is transferred to a subsequent transport device in a transfer area, and in the transfer area the deflection device acts on the filling product accommodated in the container. In this manner the performance of the system can be further improved, since a clean transfer of the filled container can be achieved and loss of filling product can be avoided.

A particularly cost-effective design of the deflection device can be achieved if the deflection device uses at least one electrostatically charged element, such as for example plastic or hard rubber, in order to achieve a deflection of the stream of filling product and/or a deflection of the filling product.

Alternatively, or in addition, the deflection device can also include a capacitor, for example a plate capacitor. The electrostatic field is then established between the capacitor plates. An advantage of the design using a capacitor is that the strength of the electrostatic field can be regulated via the voltage that is applied, and thus the electrostatic field that is established, and hence the resultant spatial deflection of the filling product, can be adapted to the particular filling product, its viscosity and water content, and the corresponding system settings, for example the speeds of rotation of a carousel of a filler, transport starwheel or capper. By regulating the strength of the electrostatic field that is established, it is thus also possible to achieve regulation of the deflection that is achieved, and thereby achieve flexible control of a system which can adapt to differing output levels, differing products and differing container shapes.

The deflection device is generally displaced together with a transport device for transporting the container. The envisaged deflection device can for example be displaced together with the applicable rotating transport device. It can for example be disposed in the area of the container receptacles or filling elements, and be displaced together with these. Such an arrangement requires, however, that each container holder is equipped with a deflection device.

Alternatively, or in addition, the deflection device can be stationary and can extend along a transport region in which deflection is required. This can be, for example, in the transport region of a rotary filler in which the actual filling of the container with the filling product takes place by the free jet method. This region is not usually the entire circumference, since filling usually takes place only in a predetermined treatment sector.

The deflection device can further also be provided in regions in which the transfer of containers from one transport device to a further transport device takes place.

BRIEF DESCRIPTION OF THE FIGURES

Further embodiments of the invention are more fully explained by the description below of the figures.

DETAILED DESCRIPTION

Examples of embodiments are described below with the aid of the figures. In the figures, elements which are identical or similar, or have identical effects, are designated with identical reference signs. In order to avoid redundancy, repeated description of these elements is in part dispensed with in the description below.

Figure 1:
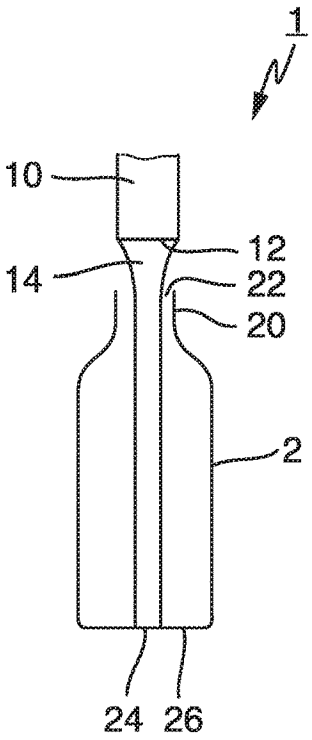
FIG. 1 is a schematic representation of a free jet filling process in which a container is filled when at rest.
Figure 8:
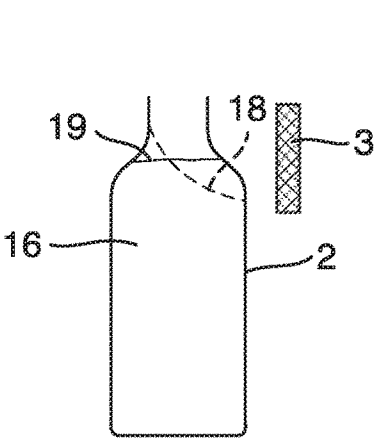
FIG. 8 is a schematic representation of the transfer of a container that is filled with a filling product from a rotary-type transport device to a subsequent rotary-type transport device, wherein the deflection device that is proposed here is provided.

FIG. 1 shows schematically a section of a filling system 1, wherein the filling system 1 has a rotary-type filling device with a filling element 10, which has a filling product outlet 12. The filling product flows out of the filling element 10, i.e. out of the filling product outlet 12 of the filling element 10, and flows as a stream of filling product 14 into a container 2 that is to be filled, which has a neck area 20 that defines a container mouth 22. The stream of filling product 14 flows through the container mouth 22 of the container 2 that is to be filled into the interior of the container 2 that is to be filled. If the container 2 that is to be filled is still completely empty, the stream of filling product 14 impinges upon a point of impingement 24 on the base 26 of the container 2 that is to be filled.

The example embodiment shown in FIG. 1 is a section of a filling system 1, which usually has a plurality of filling elements 10 disposed around the periphery of a rotary filler. As the filling elements 10 circulate, the containers 2 that are disposed below the filling elements, and circulate together with them, are filled with the filling product.

In the example embodiments shown here, the filling elements 10 are provided for free jet filling. Accordingly, the container 2 that is to be filled is not pressed onto the filling element 10. Instead, there is an open space between these, through which the stream of filling product 14 from the filling product outlet 12 of the filling element 10 flows before it enters the container mouth 22 of the container 2 that is to be filled. In other words, there is at least one portion of the stream of filling product 14 which is not directly surrounded by either the filling element 10 or the container 2, and in which the filling product falls, as it were, freely through the open space.

In the at rest state shown in FIG. 1, the stream of filling product 14 thus falls through the middle of the container 2 that is to be filled, and impinges upon the center of the base 26 at the point of impingement 24.

Figure 2:
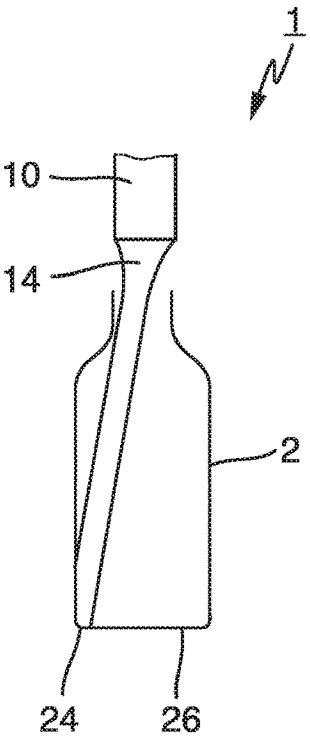
FIG. 2 is a schematic representation of a free jet filling process in a rotary-type filler at a low speed of rotation according to the state of the art.

FIG. 2 shows the same configuration as FIG. 1, but in this case both the container 2 that is to be filled and the filling element 10 are undergoing a rotational displacement about an axis of the rotary filler. It can be seen that the stream of filling product 14 is deflected outwards due to the centrifugal forces that now arise. Thus the stream of filling product 14 no longer impinges upon the center of the base 26 of the container 2 that is to be filled. Instead, the point of impingement 24 moves outwards, and in the example embodiment that is shown the stream of filling product 14 impinges exactly in the angle between the base 26 and the cylindrical wall of the container 2 that is to be filled. Due to this, the tendency to foam can increase, such that even a moderate rotational speed of the rotary filler causes a stronger tendency to foam. As a result, the filling process as a whole cannot be further accelerated, and/or the filling process may be subject to a limitation relating to the reaching of the actual end of filling.

Figure 3:
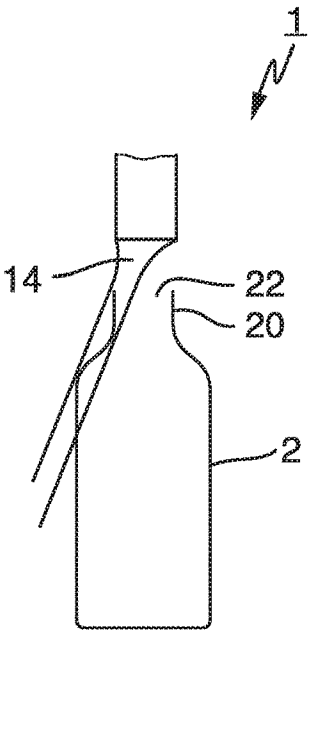
FIG. 3 is a schematic representation of a free jet filling process in a rotary-type filler at a high speed of rotation according to the state of the art.

FIG. 3 shows the device that was shown in FIGS. 1 and 2, in a state in which the rotary filler rotates so rapidly that the stream of filling product 14 is deflected by the centrifugal force, to the extent that part of it strikes the neck area 20 of the container 2 that is to be filled, and due to this not all of the stream of filling product 14 now passes through the container mouth 22 into the container 2. FIG. 3 thus shows a situation in which spattering or overflow of the stream of filling product 14 can be observed, as a result of the deflection of the stream of filling product 14 caused by the centrifugal force. The filling outcome is therefore not satisfactory, since the quantity of filling product to be introduced into the container 2 that is to be filled cannot be measured accurately. Furthermore, the plant and the container are contaminated by filling product which flows down the outside of the container. In addition, filling product is wasted, since it does not enter the container 2 that is to be filled, and instead must be discarded.

Figure 4:
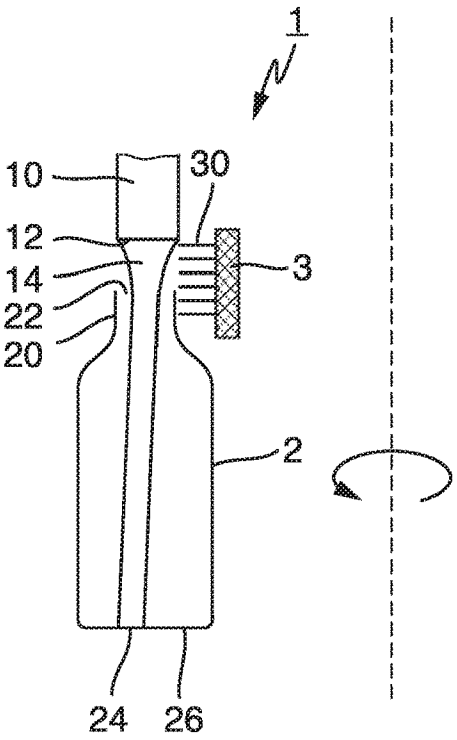
FIG. 4 is a schematic representation of a free jet filling process in a rotary-type filler at a high speed of rotation, wherein the deflection device that is proposed here is provided.

FIG. 4 shows a filling system 1 as proposed here, which has a filling element 10 disposed on a rotary filler. The filling element 10 is again provided for filling a container 2 with a filling product by means of a stream of filling product 14. A deflection device 3 is provided, at least in the region in which the stream of filling product 14 falls freely, i.e. at least in the region from the point at which the stream of filling product 14 leaves the filling product outlet 12 of the filling element 10, to the point at which the stream of filling product 14 enters the container mouth 22 of the container 2 that is to be filled. The deflection device 3 can, however, also be provided in additional regions of the stream of filling product 14, and can also act on the entire stream of filling product 14.

The deflection device 3 provides an electrostatic field 30, which acts on the stream of filling product 14 such as to deflect it in the direction of the deflection device 3 shown in FIG. 4.

If the device shown in FIG. 4, in particular the filling element 10 together with the container 2 that is to be filled, now rotates about the axis of the rotary filler, the centrifugal force that is actually acting on the stream of filling product 14 can be counteracted by means of the provision of the deflection device 3. Accordingly, the strong deflection of the stream of filling product 14 that is shown in FIG. 3 can be reduced or fully compensated by the provision of the deflection device 3. The force applied to the filling product, i.e. to the stream of filling product 14, by the deflection device 3, i.e. by the electrostatic field 30 of the deflection device 3, is opposed to the centrifugal force that arises, such that the resulting force acting on the stream of filling product 14 is reduced or fully compensated.

Accordingly the point of impingement 24 moves, by comparison with the state shown in FIG. 3, back to the base 26 of the container 2 that is to be filled. Thus by means of the provision of the deflection device 3 it can be achieved not only that that the full stream of filling product 14 again enters the container 2 that is to be filled through the container mouth 22, but also that the point of impingement 24 on the base 26 of the container 2 that is to be filled can be brought back far enough to reduce advantageously the tendency to foam.

Thus it can be achieved that the system 1 can also be operated at higher or high rotational speeds of the rotary filler, without the displacement outwards of the stream of filling product 14 such as is shown in FIG. 3, which causes a loss of filling product, inaccurate filling of the container 2 that is to be filled, and contamination of the plant.

Accordingly, the overall performance of the plant can be enhanced in this manner.

In the example embodiment that is shown, the deflection device 3 is designed in the form of a capacitor plate of a plate capacitor, which is charged such as to achieve an attraction of the stream of filling product 14 contrary to its deflection by the centrifugal forces.

In the example embodiment that is shown, the deflection device 3 is disposed in a stationary position, and does not rotate with the rotary filler. Instead, the stationary deflection device 3 is provided only in those areas of the rotary filler in which free jet filling of containers that are to be filled with the filling product actually takes place. In particular, the deflection device 3 is not provided in those areas in which the container 2 is received into the rotary filler, or in the areas in which settling of the filling product takes place before the filled container is transferred to a subsequent transport device.

The deflection device 3 is typically provided in the form of a capacitor, wherein the electrostatic field that acts on the filling product can be adjusted via the voltage applied to the capacitor. Thus the deflection carried out by means of the deflection device 3 can also be adjusted to the respective machine speeds, in particular to the speeds of rotation and the centrifugal forces that these create. By this means it is possible to approximate to, or maintain, an optimum point of impingement 24 at all times, in order to reduce the periods that are provided to allow the filling product in the container to settle.

The deflection device 3 can also be provided by an electrostatically charged element, for example an electrostatically charged plate. The electrostatically charged element can be provided for example in the form of a plastic or hard rubber material. Such a design has the advantage that in this case no separate voltage source is necessary in order to charge the element. It is for example possible to maintain an electrostatic charge of a stationary electrostatically charged element by passing it across a charging element that is disposed on the rotary device. By this means the electrostatic charge of the deflection element 3 persists throughout the entire filling operation.

FIGS. 5 to 8 show a filled container 2 which has already been filled with filling product 16. Such a state of a filled container 2 is for example reached at the conclusion of the filling process in the rotary filler. The filling product 16 has reached a filling product surface 18 in the filled container 2, and the container mouth 22 is still open. In other words, the container 2 has already been filled with the filling product, but has not yet been closed.

Figure 5:
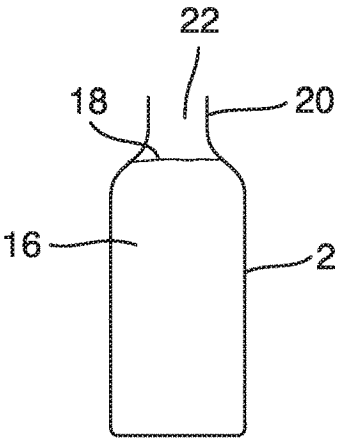
FIG. 5 is a schematic representation of a container that is filled with a filling product and is at rest.

If the filled container is at rest, for example as shown schematically in FIG. 5, the filling product surface 18 is substantially horizontal.

Figure 6:
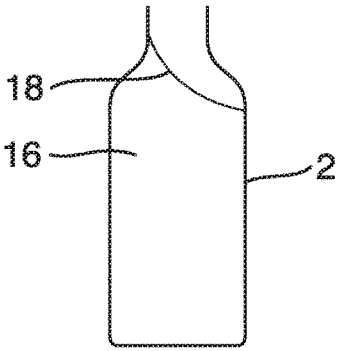
FIG. 6 is a schematic representation of a container that is filled with a filling product and is in a rotary-type transport device at a high speed of rotation according to the state of the art.

FIG. 6 shows the container from FIG. 5 in a transport device which is rotating. In this case the filled container 2 is held on the periphery of a transport carousel, a transport starwheel, or also for example the filling device, and then circulates about the axis of the applicable carousel. Consequently, the filling product surface 18 is pushed outwards due to the action of the centrifugal force, and forms a meniscus.

When the filled container 2 is transferred from one rotating transport device to another subsequent rotating transport device, the previously deflected filling product surface 18, as shown in FIG. 6, is deflected in the opposite direction due to the transfer to a subsequent transport device, causing an opposite deflection 19 of the filling product surface. This opposite deflection 19 occurs because the direction in which the centrifugal force acts on the filling product 16 in the filled container 2 changes abruptly due to the abrupt change in the axes of rotation during the transfer from one transport device to the next.

Figure 7:
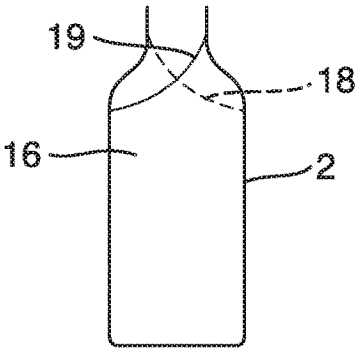
FIG. 7 is a schematic representation of the transfer of a container that is filled with a filling product from a rotary-type transport device to a subsequent rotary-type transport device according to the state of the art.

Thus the transfer of the filled container 2 from one transport device to the next leads to a strong deflection of the filling product surface 18 from the position indicated by reference sign 18 to the position indicated by reference sign 19 in FIG. 7. Depending on the speed of transfer and the abruptness of the change in the forces acting on the filling product, this can result in the filling product sloshing over through the container mouth 22. This sloshing over takes place, among other reasons, because when the force acting on the filling product changes, a superimposition of forces occurs, which can lead to sloshing over.

FIG. 8 again shows the deflection device 3 that is proposed here, by means of which the centrifugal forces that act in each case can be counteracted. In the example embodiment that is shown, it is envisaged that the filling product surface 18, which was previously deflected, as shown for example in FIG. 6, due to the circulation of the filled container 2 about the central axis of the carousel, is influenced and straightened, so to speak, by the application of the deflection device 3, as shown by reference sign 19. Accordingly, when the filled container is then transferred to a subsequent transport device, the sloshing motion can be reduced. The occurrence of sloshing motions can be still further reduced, or even substantially eliminated, by means of the provision on the subsequent transport device of a further deflection device on the opposite side.

In consequence, by the use of the deflection device 3, which provides an electrostatic field 30, it is possible to reduce or eliminate both the unsatisfactory impingement or aiming of a free jet at high speeds of rotation, and the sloshing over of filling product during the transfer from one rotating transport device to a subsequent rotating transport device.

To the extent applicable, all individual features that are described in the individual example embodiments can be combined with each other and/or exchanged, without departing from the field of the invention.

The invention claimed is:

1. A filling system for filling a container with a filling product, comprising:

a filling device configured to fill the container with the filling product;

a deflection device having an electrostatic field configured to deflect the filling product into the container; and a first transport device configured to transport a filled container.

2. The filling system of claim 1, wherein the filling device is configured to fill the container by a free jet method, and the deflection device acts on the filling product.

3. The filling system of claim 1, wherein the deflection device is configured to move with the first transport device.

4. The filling system of claim 1, wherein the deflection device is configured to act on the filling product in the filled container.

5. The filling system of claim 1, wherein the deflection device is stationary and extends along a transport region of the container.

6. The filling system of claim 1, further comprising a second transport device in a transfer area that is configured to receive the filled container from the first transport device.

7. The filling system of claim 6, wherein the deflection device is configured to act on the filling product in the filled container in the transfer area.

8. The filling system of claim 1, wherein the deflection device comprises an electrostatically charged element.

9. The filling system of claim 8, wherein the electrostatically charged element comprises a plastic or a rubber.

10. The filling system of claim 1, wherein the deflection device comprises a capacitor.

11. The filling system of claim 10, wherein the capacitor comprises a plate capacitor.

12. A filling system for filling a container with a filling product, comprising:

a filling device configured to fill the container with the filling product;

a deflection device having an electrostatic field configured to deflect the filling product into the container, wherein the deflection device is disposed at least in a region between the filling device and the container; and a first transport device configured to transport a filled container.

13. The filling system of claim 12, wherein the filling device is configured to fill the container by a free jet method, and the deflection device acts on the filling product.

14. The filling system of claim 12, wherein the deflection device is configured to act on the filling product in the filled container.

15. The filling system of claim 12, further comprising a second transport device in a transfer area that is configured to receive the filled container from the first transport device.

16. The filling system of claim 12, wherein the deflection device comprises an electrostatically charged element.

17. The filling system of claim 12, wherein the deflection device comprises a capacitor.

18. The filling system of claim 12, wherein the deflection device is stationary and extends along a transport region of the container.

* * * * *